US007600645B2

(12) United States Patent
Gregory

(10) Patent No.: US 7,600,645 B2
(45) **Date of Patent: *Oct. 13, 2009**

(54) TIE RACK

(76) Inventor: David M. Gregory, 7324 Hummingbird Cir., Oklahoma City, OK (US) 73162

( * ) Notice: Subject to any disclaimer, the term of this patent is extended or adjusted under 35 U.S.C. 154(b) by 0 days.

This patent is subject to a terminal disclaimer.

(21) Appl. No.: 11/375,298

(22) Filed: Mar. 14, 2006

(65) Prior Publication Data

US 2006/0266721 A1 Nov. 30, 2006

Related U.S. Application Data

(63) Continuation-in-part of application No. 11/135,970, filed on May 24, 2005.

(51) Int. Cl.
*A47F 5/08* (2006.01)

(52) U.S. Cl. ..... 211/87.01; 211/85.3

(58) Field of Classification Search ..... 211/85.3, 211/85.2, 60.1, 61, 16, 119.003, 90.01, 123, 211/105.1, 13.1, 85.9, 44, 87.01, 88.04, 99, 211/100; 223/DIG. 1.85; 206/6.1
See application file for complete search history.

(56) References Cited

U.S. PATENT DOCUMENTS 1,692,059 A * 11/1928 Starner ..... 211/123
2,128,606 A * 8/1938 Voss, Jr. ..... 211/85.3
2,267,014 A * 12/1941 Case ..... 211/123
2,271,784 A * 2/1942 Tritt ..... 248/218.2
2,398,858 A * 4/1946 Rosenblatt ..... 211/96
2,428,454 A * 10/1947 Fowler ..... 211/104
2,603,359 A * 7/1952 Pestyner ..... 211/85.3
2,622,742 A * 12/1952 Oldham ..... 211/113
2,724,510 A * 11/1955 Williams ..... 211/104
D190,552 S * 6/1961 Doucet ..... D6/548
3,118,542 A * 1/1964 Lewis ..... 211/85.3
3,853,225 A * 12/1974 Gegauff ..... 211/85.3
D242,414 S * 11/1976 Salladay ..... D6/315
4,109,794 A * 8/1978 Samuel et al. ..... 211/85.3
4,290,531 A * 9/1981 Lazarus, III ..... 211/85.29
5,149,003 A 9/1992 Tharp
5,373,950 A 12/1994 Marc
5,425,463 A 6/1995 Toscanini et al.
D422,795 S 4/2000 Hollinger
6,390,308 B1 * 5/2002 Ebrahim ..... 211/85.3

* cited by examiner

*Primary Examiner*—Jennifer E. Novosad
(74) *Attorney, Agent, or Firm*—Dunlap Codding, P.C.

(57) ABSTRACT

A tie rack includes a mounting plate, a first side arm extending from the mounting plate, second side arm in a spaced apart, parallel relationship to the first side arm. A first mounting rod extends from the first side arm toward the second side arm, and a second mounting rod extends from the second side arm toward the first side arm. The second mounting rod has a distal end in a spaced apart relationship with the distal end of the first mounting rod. A drag rod extends between the first side arm and the second side arm in a spaced apart and parallel relationship to the first mounting rod and the second mounting rod such that when a tie is looped over one of the mounting rods with two portions of the tie extending therefrom, the two portions are extendable over one side of the drag rod.

5 Claims, 4 Drawing Sheets

TIE RACK

CROSS REFERENCE TO RELATED APPLICATIONS

This application is a continuation-in-part of U.S. patent application Ser. No. 11/135,970, filed May 24, 2005, which is incorporated herein by reference in its entirety.

BACKGROUND OF THE INVENTION

1. Field of the Invention

This invention relates generally to racks, and more particularly, but not by way of limitation, to an improved rack for holding ties, scarfs, and the like.

2. Brief Description of Related Art

Various kinds of tie racks are known in the art, including a type having a plurality of pivotable arms which are located adjacent one another on a support and which, when access is desired to the ties, are pivoted to a position in which they extend at right angles to the support. The support is intended to be mounted on a wall or door of a clothes closet, or in a similar position. Each of the arms has a length that is just sufficient to support a single tie, and the arms are spaced from one another in direction transversely of their pivot axis by a distance which is slightly longer than the length of the arms so that, when the arms are pivoted back against the support to a storage position, all the arms will become located in a common plane with the free end of one arm being located adjacent the pivoted end of the next arm, and so on. An arrangement is provided which is coupled with all of the arms in order to pivot all of the arms simultaneously to the storage position or to the access position.

Other types of racks have arms that are fixed to a support frame or to a carousel mechanism that allows the arms to be selectively rotated until the desired tie is located. Like the pivoting arms described above, each of the fixed arms has a length that is just sufficient to support a single tie.

Because of the limited size of the arms of many tie racks and the close proximity of one arm to an adjacent arm, the act of removing a selected tie from an arm and placing the tie back on the arm is a tedious endeavor that often results in adjacent ties being knocked off their respective arms.

To this end, a need exists for an improved tie rack that is capable of supporting multiple ties while allowing a selected tie to be easily removed and replaced without disrupting the other ties supported on the rack. It is to such an improved tie rack that the present invention is directed.

DETAILED DESCRIPTION OF THE INVENTION

Figure 1:
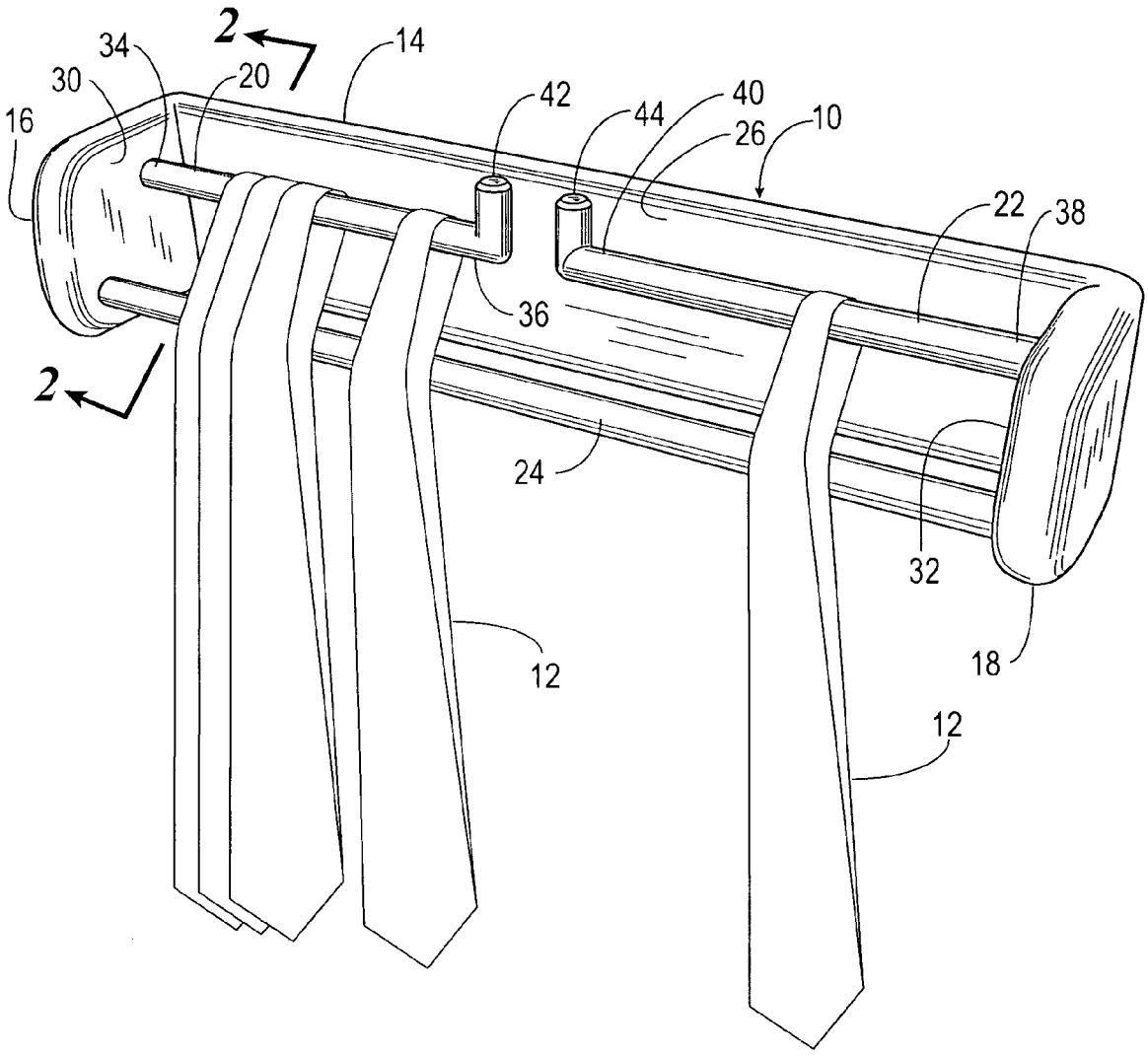
FIG. 1 is a perspective view of a tie rack constructed in accordance with the present invention shown supporting a plurality of ties.
Figure 2:
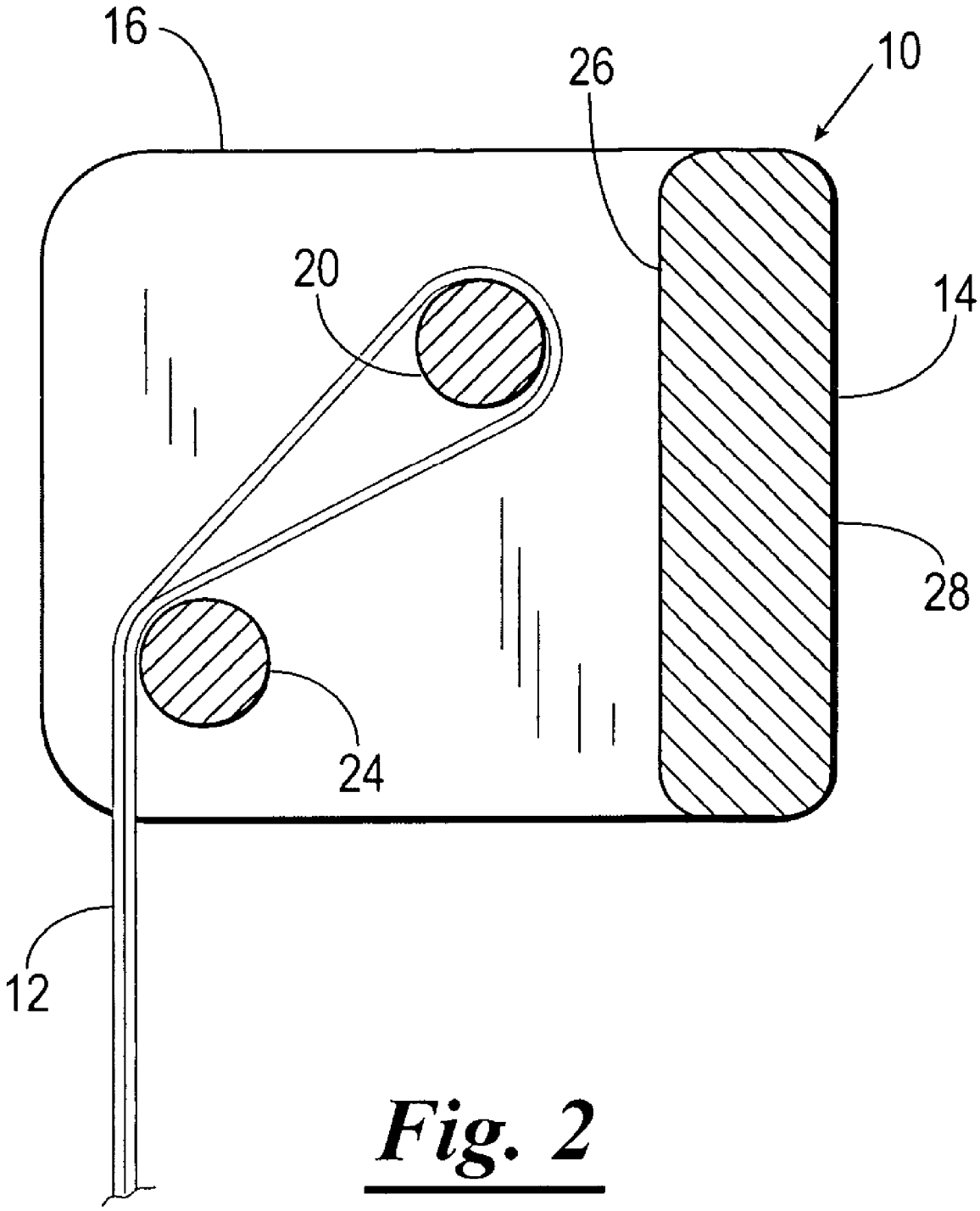
FIG. 2 is a sectional view taken along line 2-2 of FIG. 1.

Referring now to the drawings, and more particularly FIGS. 1 and 2, a tie rack 10 constructed in accordance with the present invention is shown supporting a plurality of neck ties 12. Broadly, the tie rack 10 includes a mounting plate 14, a first side arm 16, a second side arm 18, a first mounting rod 20, a second mounting rod 22, and a drag member 24.

The mounting plate 14 is a planar member having a front surface 26 and a back surface 28 (FIG. 2). The mounting plate 14 is mountable to a support surface, such as a door or a wall with suitable fasteners.

The first side arm 16 and the second side arm 18 extend perpendicularly from the front surface 26 of the mounting plate 14 in a spaced apart, parallel relationship to each other. It will be appreciated that the first side arm 16 and the second side arm 18 may be mounted directly to a support surface, such as a wall or door, thereby eliminating the need for the mounting plate 14. The first side arm 16 has an inner facing surface 30, and the second side arm 18 has an inner facing surface 32.

The first mounting rod 20 has a proximal end 34 and a distal end 36. Similarly, the second mounting rod 22 has a proximal end 38 and a distal end 40. The proximal end 34 of the first mounting rod 20 is connected to the first side arm 16 so that the first mounting rod 16 extends from the inner facing surface 30 of the first side arm 16 toward the second side arm 18. Likewise, the proximal end 38 of the second mounting rod 22 is connected to the second side arm 18 so that the second mounting rod 22 extends from the inner facing surface 32 of the second side arm 18 toward the first side arm 16. In a preferred embodiment, the second mounting rod 18 is positioned in axial alignment with the first mounting rod 20, and the distal end 40 of the second mounting rod 22 is in a spaced relationship with respect to the distal end 36 of the first mounting rod 20. The distal end 36 of the first mounting rod 20 is provided with a catch member 42, and the distal end 40 of the second mounting rod 22 is provided with a catch member 44. The distal end 40 of the second mounting rod 22 is preferably spaced from the distal end 36 of the first mounting rod 20*a* distance of at least approximately 1.5 inches to facilitate the positioning of a tie on one of the first mounting rod 20 and the second mounting rod 22. It should be understood that the tie rack 10 may be constructed to have only one mounting rod instead of two as described above.

The drag member 24 is connected to the first side arm 16 and the second side arm 18 such that the drag member 24 extends there between. The drag member 24 is shown to be a rod positioned in a spaced apart and parallel relationship to the first mounting rod 20 and the second mounting rod 22 such that when a tie, such as tie 12*a*, is looped over one of the mounting rods 20, 22 with two portions 46 and 48 of the tie 12*a* extending from the mounting bar 20 or 22, the two portions 46 and 48 are extendable over one side of the drag member 24. Preferably, the drag member 24 is vertically offset from the first mounting rod 20 and the second mounting rod 22, and the drag member 24 is positioned below and forward of the first mounting rod 20 and the second mounting rod 22.

In the preferred embodiment, the first mounting rod 20 and the second mounting rod 22 are cylindrically shaped and have a diameter of, for example, about 0.75 inches. However, it should be understood that the diameter of the first mounting rod 20 and the second mounting rod 22 may be greater than or less than 0.75 inches so long as the first mounting rod 20 and the second mounting rod 22 provide sufficient drag. Similarly, the drag member 24 is cylindrical in shape and has a diameter of, for example, about 0.75 inches, but may be constructed to have any diameter so long as the drag member 24 provides sufficient drag. In the illustrated embodiment, the drag member 24 is vertically spaced from the first mounting rod 20 and the second mounting rod 22*a* distance of approximately 1.5 inches and horizontally spaced a distance of about 2 inches, but it will be appreciated that the drag member 24 may be spaced from the first mounting rod 20 and the second mounting rod 22 at a variety of distance so long as the tie rack 10 functions in a manner described herein.

The components of the tie rack 10 may be fabricated of any suitable material, such as wood, plastic, or metal. However, as will become apparent below, the drag member 24 should have an outer surface such that the coefficient of friction between the ties 12 and the outer surface of the drag member 24 is greater than the coefficient of friction between the overlapping ties 12. To this end, the outer surface of the drag member 24 is provided with a texture, such as by roughing the outer surface of the drag member 24 should it be fabricated of wood, or lining the drag member 24 with a material having a higher coefficient of friction than the ties 12, such as wool, cotton, or the like.

In use, the ties 12 are looped over the mounting rods 20, 22 such that the portions 46 and 48 of the ties 12 extend from the mounting rods 20, 22. The portions 46 and 48 of the ties 12 are extended over one side of the drag member 24. As such, at least one of the portions 46, 48 of the ties 12 extend in a serpentine pattern. The ties 12 may be positioned on the first and second mounting rods 20, 22 in a random fashion without the need to meticulously place each tie 12 in a particular location. As such, the placing of the ties 12 on the tie rack 10 is easily accomplished.

In removing a tie 12 from the tie rack 10, a desired tie 12 is first selected. One portion 46, 48 of the selected tie 12 is then grasped and simply pulled off the drag member 24 and the mounting rod 20 or 22. Because of the friction between the drag member 24, and the non-selected ties 12, the selected tie 12 is removed from the tie rack 10 without causing the non-selected ties 12 positioned on the mounting rod 20, 22 to be pulled along with the selected tie 12.

While the tie rack 10 has been described for use in supporting neck ties, it will be appreciated that the tie rack 10 of the present invention is not limited to such use and may be used to support other objects, such as scarfs and handkerchiefs. Also, it will be appreciated that the tie rack 10 may be made in any length depending on the number of ties one has and amount of wall space available.

Figure 3:
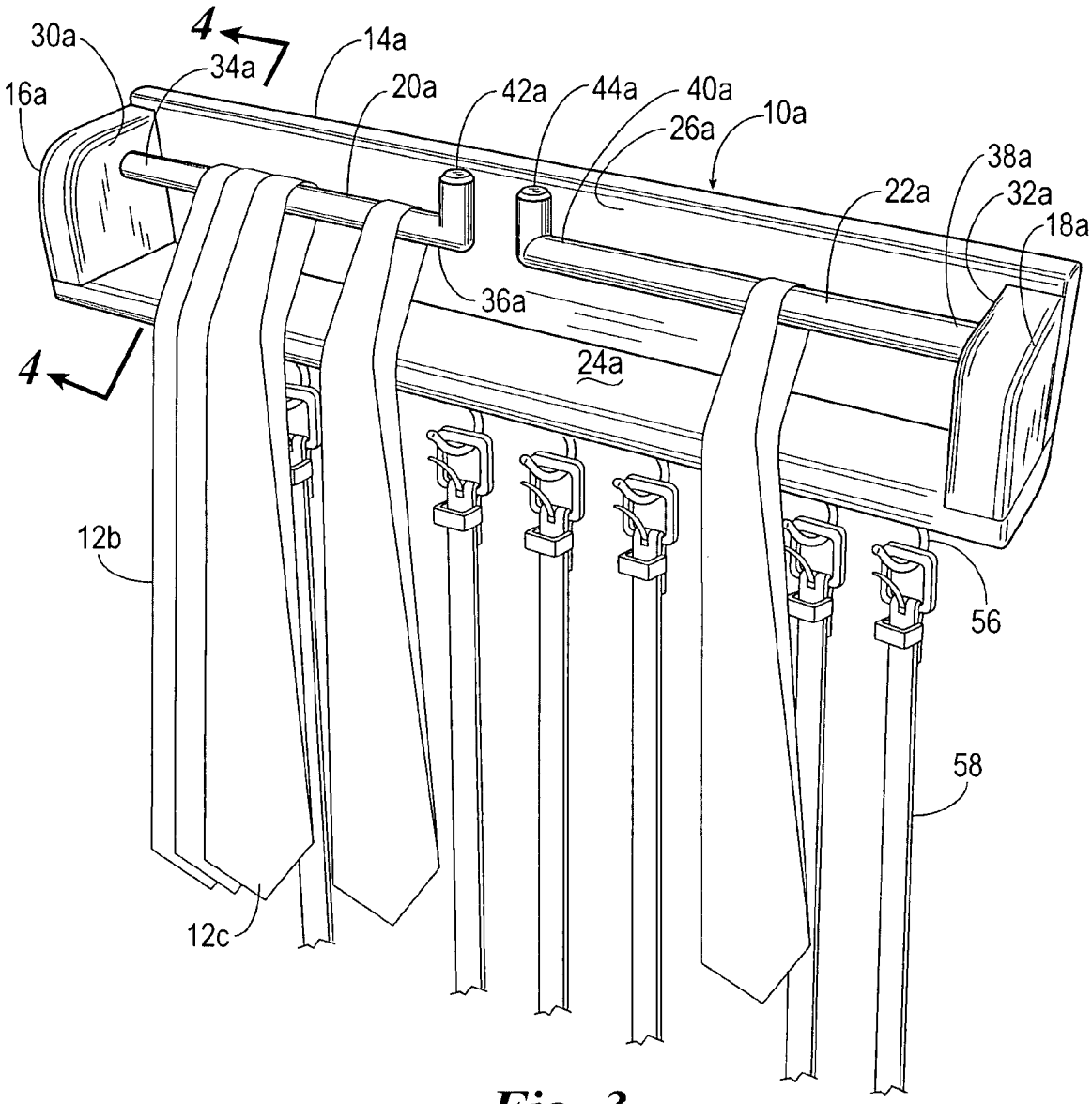
FIG. 3 is a perspective view of another embodiment of a tire rack constructed in accordance with the present invention shown supporting a plurality of ties.

Referring now to FIG. 3, a tie rack 10*a* constructed in accordance with the present invention is shown supporting a plurality of neck ties 12*b*. Broadly, the tie rack 10*a* includes a mounting plate 14*a*, a first side arm 16*a*, a second side arm 18*a*, a first mounting rod 20*a*, a second mounting rod 22*a*, and a drag member 24*a*.

Figure 4:
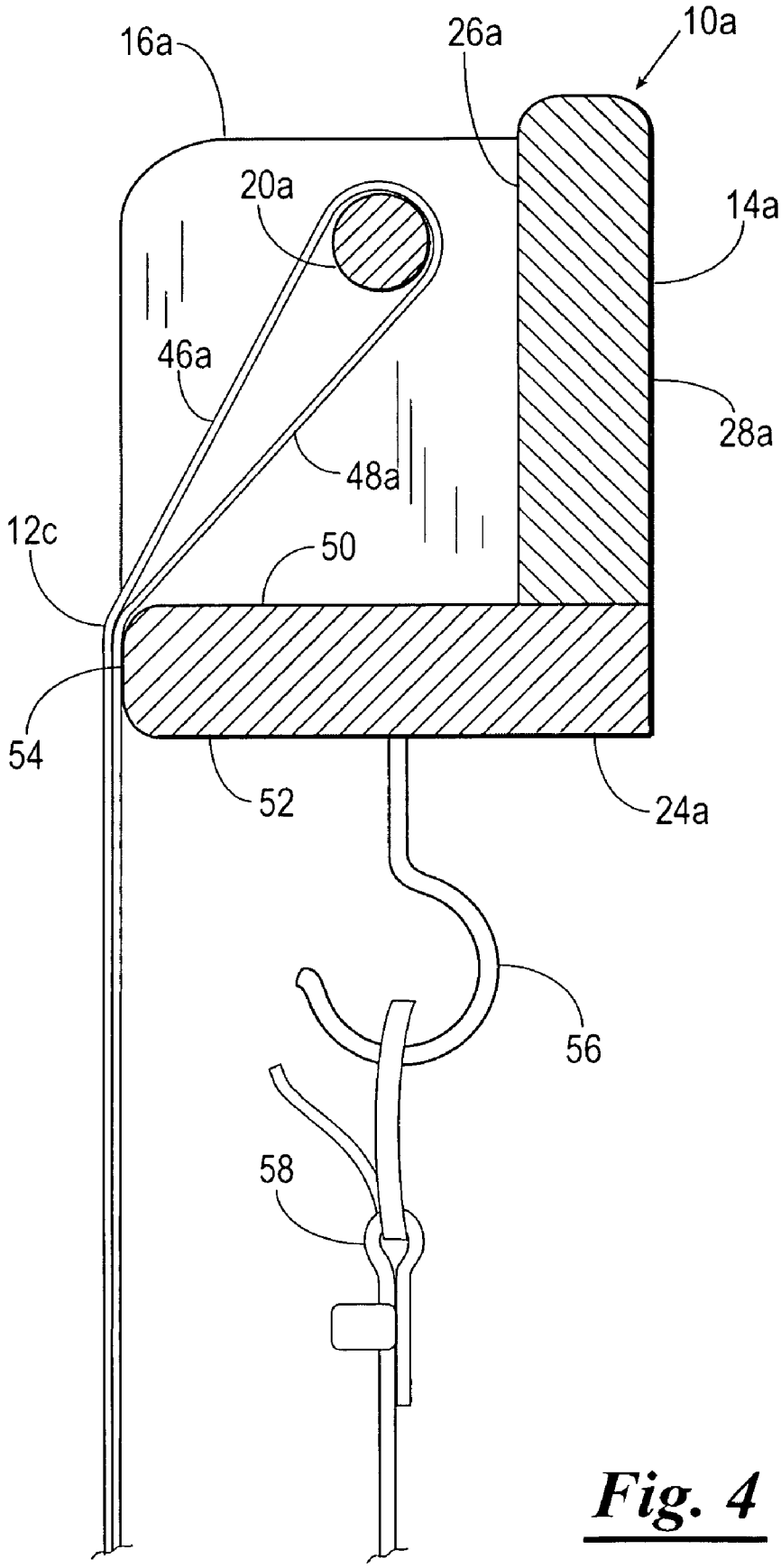
FIG. 4 is a sectional view taken along line 4-4 of FIG. 3.

The mounting plate 14*a* is a planar member having a front surface 26*a* and a back surface 28*a* (FIG. 4). The mounting plate 14*a* is mountable to a support surface, such as a door or a wall with suitable fasteners.

The first side arm 16*a* and the second side arm 18*a* extend perpendicularly from the front surface 26*a* of the mounting plate 14*a* in a spaced apart, parallel relationship to each other. It will be appreciated that the first side arm 16*a* and the second side arm 18*a* may be mounted directly to a support surface, such as a wall or door, thereby eliminating the need for the mounting plate 14*a*. The first side arm 16*a* has an inner facing surface 30*a*, and the second side arm 18*a* has an inner facing surface 32*a*.

The first mounting rod 20*a* has a proximal end 34*a* and a distal end 36*a*. Similarly, the second mounting rod 22*a* has a proximal end 38*a* and a distal end 40*a*. The proximal end 34*a* of the first mounting rod 20*a* is connected to the first side arm 16*a* so that the first mounting rod 16*a* extends from the inner facing surface 30*a* of the first side arm 16*a* toward the second side arm 18*a*. Likewise, the proximal end 38*a* of the second mounting rod 22*a* is connected to the second side arm 18*a* so that the second mounting rod 22*a* extends from the inner facing surface 32*a* of the second side arm 18*a* toward the first side arm 16*a*.

In a preferred embodiment, the second mounting rod 18*a* is positioned in axial alignment with the first mounting rod 20*a*, and the distal end 40*a* of the second mounting rod 22*a* is in a spaced relationship with respect to the distal end 36*a* of the first mounting rod 20*a*. The distal end 36*a* of the first mounting rod 20*a* is provided with a catch member 42*a*, and the distal end 40*a* of the second mounting rod 22*a* is provided with a catch member 44*a*. The distal end 40*a* of the second mounting rod 22*a* is preferably spaced from the distal end 36*a* of the first mounting rod 20*a* a distance of at least approximately 1.5 inches to facilitate the positioning of a tie on one of the first mounting rod 20*a* and the second mounting rod 22*a*. It should be understood that the tie rack 10*a* may be constructed to have only one mounting rod instead of two as described above.

The drag member 24*a* is shown to be a shelf having an upper surface 50, a lower surface 52, and a drag surface 54. The drag member 24*a* is connected to the mounting plate 14*a* and extends a distance outwardly therefrom forming a shelf for placement of objects thereon. The drag member 24*a* is further connected to the first side arm 16*a* and the second side arm 18*a* such that the drag member 24*a* extends there between. In addition to the embodiment shown in FIGS. 3 and 4, it should be understood that the drag member 24*a* may be formed as multiple sections which are spaced from one another.

Shown in FIGS. 3 and 4, the drag member 24*a* is positioned perpendicularly to the mounting plate 14*a*. However, it should be understood that the drag member 24*a* may be positioned at a non-perpendicular angle relative to the mounting plate 14*a* such that the mounting plate 14*a* and the drag member 24*a* cooperate to form a retaining space for placement of objects therein when the angle between the drag member 24*a* and the mounting plate 14*a* is less than 90 degrees.

The drag member 24*a* having the drag surface 54 is supported relative to one of the first mounting rod 20*a* and the second mounting rod 22*a* in a spaced apart and parallel relationship to one of the first mounting rod 20*a* and the second mounting rod 22*a* such that when a tie, such as the tie 12*c*, is looped over one of the mounting rods 20*a*, 22*a* with two portions 46*a*, 48*a* of the tie 12*c* extending from the mounting rod 20*a* or 22*a*, the two portions 46*a*, 48*a* are extendable over the drag surface 54 of the drag member 24*a*. Preferably, the drag surface 54 of the drag member 24*a* is vertically offset from the first mounting rod 20 and the second mounting rod 22, and the drag surface 54 of the drag member 24*a* is positioned below and forward of the first mounting rod 20*a* and the second mounting rod 22*a*.

The tie rack 10*a* further includes a plurality of hook members 56 extending from the lower surface 52 of the drag member 24*a* for receiving an object, such as a belt 58, as shown in FIG. 3. It will be appreciated that the hook member 56 may be any member capable of supporting an object thereon. It will also be appreciated that the hook member 56 is not limited to such use and may be used to support other objects in addition to the belt 58 such as purses and the like.

The components of the tie rack 10*a* may be fabricated of any suitable material, such as wood, plastic, or metal. However, as will become apparent below, the drag surface 54 of the drag member 24*a* should be formed such that the coefficient of friction between the ties 12*b* and the drag surface 54 of the drag member 24*a* is greater than the coefficient of friction between the overlapping ties 12*b*. To this end, the drag surface 54 of the drag member 24*a* is provided with a texture, such as by roughing the drag surface 54 of the drag member 24*a* should it be fabricated of wood, or lining the drag surface 54 with a material having a higher coefficient of friction than the ties 12*b*, such as wool, cotton, or the like.

In use, the ties 12*b* are looped over the mounting rods 20*a*, 22*a* such that the portions 46*a*, 48*a* of the ties 12*b* extend from the mounting rods 20*a*, 22*a*. The portions 46*a* and 48*a* of the ties 12*b* are extended over the drag surface 54 of the drag member 24*a*. As such, at least one of the portions 46*a*, 48*a* of the ties 12*b* extend in a serpentine pattern. The ties 12*b* may be positioned on the first and second mounting rods 20*a*, 22*a* in a random fashion without the need to meticulously place each tie 12*c* in a particular location. As such, the placing of the ties 12*b* on the tie rack 10*a* is easily accomplished.

In removing a tie 12*c* from the tie rack 10*a*, a desired tie 12*c* is first selected. One portion 46*a*, 48*a* of the selected tie 12*c* is then grasped and simply pulled off the drag member 24*a* and the mounting rod 20*a* or 22*a*. Because of the friction between the drag surface 54 of the drag rod 24*a*, and the non-selected ties 12*b*, the selected tie 12*c* is removed from the tie rack 10*a* without causing the non-selected ties 12*b* positioned on the mounting rod 20*a*, 22*a* to be pulled along with the selected tie 12*c*.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A tie rack in combination with a plurality of ties, the tie rack comprising:

a first side arm mounted to a support surface;

a second side arm mounted to the support surface in a spaced apart relationship to the first side arm;

a mounting rod extending from the first side arm toward the second side arm; and a drag member extending between the first side arm and the second side arm, the drag member having a drag surface vertically and horizontally offset from the mounting rod and supported in fixed, substantially parallel, and spaced apart relation to the support surface with the drag surface positioned below and forward of the mounting rod, wherein the ties are looped over the mounting rod with the ties overlapping one another and each of the ties having two portions extending from the mounting rod and extending over a forward side of the drag surface of the drag member so that each of the two portions is supported by the drag surface, and wherein the coefficient of friction between the ties and the drag surface is greater than the coefficient of friction between overlapping ties such that upon selecting one of the ties for removal from the mounting rod and pulling one of the portions of the selected tie so as to drag the selected tie over the mounting rod and the drag surface, the selected tie slides over the non-selected ties thereby leaving the non-selected ties extending from the mounting rod.

2. The tie rack of claim 1 wherein the drag member extends from the support surface to define a shelf.

3. The tie rack of claim 1 further comprising:

a hook member extending from the drag member for receiving an object.

4. The tie rack of claim 3 wherein the hook member extends from a lower surface of the drag member.

5. A tie rack in combination with a plurality of ties, the tie rack comprising:

a first side arm mounted to a support surface;

a second side arm mounted to the support surface in a spaced apart relationship to the first side arm;

a mounting rod extending from the first side arm toward the second side arm; and a drag member extending between the first side arm and the second side arm, the drag member having an upper surface that extends from a position forward of the mounting rod to a position rearward of the mounting rod so as to form a shelf below the mounting rod, wherein the ties are looped over the mounting rod with the ties overlapping one another and each of the ties having two portions extending from the mounting rod and extending over a forward side of the drag member so that each of the two portions is supported by the member, and wherein the coefficient of friction between the ties and the drag member is greater than the coefficient of friction between overlapping ties such that upon selecting one of the ties for removal from the mounting rod and pulling one of the portions of the selected tie so as to drag the selected tie over the mounting rod and the drag member, the selected tie slides over the non-selected ties thereby leaving the non-selected ties extending from the mounting rod.

* * * * *